US011383892B2

(12) United States Patent
Druitt et al.

(10) Patent No.: US 11,383,892 B2
(45) Date of Patent: Jul. 12, 2022

(54) FLUID CONTAINER CLOSURE

(71) Applicant: CREANOVA UNIVERSAL CLOSURES LTD., Tewkesbury (GB)

(72) Inventors: Rodney Druitt, Tewkesbury (GB); James Dimond, Tewkesbury (GB)

(73) Assignee: CREANOVA UNIVERSAL CLOSURES LTD., Tewkesbury (GB)

( * ) Notice: Subject to any disclaimer, the term of this patent is extended or adjusted under 35 U.S.C. 154(b) by 0 days.

(21) Appl. No.: 16/828,204

(22) Filed: Mar. 24, 2020

(65) Prior Publication Data

US 2021/0300633 A1 Sep. 30, 2021

(51) Int. Cl.
*B65D 39/08* (2006.01)

(52) U.S. Cl.
CPC ..... *B65D 39/08* (2013.01)

(58) Field of Classification Search
CPC ..... B65D 39/08; B65D 2539/006; B65D 39/0064; B65D 41/04
See application file for complete search history.

(56) References Cited

U.S. PATENT DOCUMENTS 4,629,082 A 12/1986 Badia Iniesta
5,358,133 A * 10/1994 Gillispie ..... B65D 39/08 220/284
10,793,326 B2 * 10/2020 Migas ..... B65D 41/34
2006/0151422 A1 * 7/2006 Manley ..... B65D 39/16 215/341
2013/0276413 A1 * 10/2013 Kurmis ..... B65D 41/0435 53/484
2015/0048045 A1 * 2/2015 Miceli ..... B65D 41/04 215/201

FOREIGN PATENT DOCUMENTS

| | | | |
|---|---|---|---|
| EP | 1508527 | A1 | 2/2005 |
| ER | 1580136 | A1 | 9/2005 |
| KR | 20120006446 | U | 9/2012 |
| WO | WO 2007/034076 | A1 | 3/2007 |
| WO | WO 2011/022307 | A2 | 2/2011 |
| WO | WO 2017/063976 | A1 | 4/2017 |

OTHER PUBLICATIONS

EPO, English language version of the International Search Report, Form PCT/ISA/210 for International Application PCT/EP2021/057586, dated Jul. 22, 2021 (3 pages).
EPO, English language version of the Written Opinion of the ISA, Form PCT/ISA/237 for International Application PCT/EP2021/057586, dated Jul. 22, 2021 (9 pages).

* cited by examiner

*Primary Examiner* — Shawn M Braden
(74) *Attorney, Agent, or Firm* — Pauley Erickson & Swanson

(57) ABSTRACT

A closure (1) for a fluid container includes a top deck (11), a skirt (13) extending from the top deck (11) in an axial direction (−z), wherein the skirt (13) comprises a screw thread (14), slits (17) in the skirt (13), an elongated stabilizing section (15) and retaining means on the inside of the skirt (13) for engagement of a collar (36B) of the neck finish (31) of the fluid container (3). The closure includes torque engagement means (12) arranged on the outside of the top deck (11) for interacting with a torqueing member during fitting of the closure (1).

12 Claims, 4 Drawing Sheets

FLUID CONTAINER CLOSURE

FIELD OF THE INVENTION

The present disclosure relates to a closure for a fluid container, in particular, the field of fluid container closures, specifically towards screw closures for wine bottles.

BACKGROUND OF THE INVENTION

Description of Prior Art

Wine bottles have traditionally been sealed with a cork. While corks generally provide a good and long-lasting seal, a small proportion of corks fail and result in the wine spoiling. To avoid this, more and more wine bottles are now closed and sealed with a screw cap type of closure. However, unlike other beverage containers sealed with screw caps, sealing a fluid container containing wine presents a number of unique issues due to the properties of wine, the long time-frame that the containers typically remain sealed for, and because wine bottles are typically made of glass.

WO17063976A1 was first published in April 2017 on behalf of Vinventions USA LLC. It provides a very complex design of a closure for a receptacle for beverages in the form of a bottle with a neck. The closure comprises an inner part comprising at least one inner part plastic material. The inner part comprises a sealing means and an inner thread for cooperating with a thread finish on the neck of the bottle. An outer part comprises an outer part inner surface and an outer part outer surface. The outer part comprising a film comprising at least a first layer and at least one further layer. The outer part enclosing and hiding at least the inner part skirt.

WO11022307A2 was first published in February 2011 on behalf of William Gardner. It is directed to a plastic screw cap which has a threaded top portion and tabs of varying heights disposed around an inner circumference of a lower sleeve-portion. These tabs clasp a land disposed on a container neck to restrain the sleeve portion on the neck when the cap is unscrewed. A threaded top portion mates with threads on the container above the land. A sealing liner and diffusion barrier disposed at the bottle opening, together with a crush-resistant cap structure, prevent wine leakage and control oxygen ingress. Typically, the plastic cap is threaded onto the container neck, forming a tamper-evident seal. When unscrewed, the plastic-cap top moves up the container threads, exerting a pull on the sleeve portion, which is restrained due to the closure tabs acting on the land. Between the closure tabs and the threaded top is a break-away line, which tears due to the removal forces. This tear evidences tampering.

WO07034076A1 was first published in March 2007 on behalf of Tetra Laval Holding. The publication concerns a closure wherein the skirt is provided with a weakened peripheral zone, ruptured when the device is first opened. The skirt includes a first portion adapted to be released from the neck after the weakened zone has been ruptured and a second portion provided with a tab projecting from the inner surface of the skirt towards the first portion of the skirt and adapted at its free end to abut against an associated shoulder of the neck so as to maintain the second portion of the skirt around the neck when the device is first opened. To ensure a more resistant and more reliable retention of the second portion of the skirt, the tab has, in a longitudinal cross-section, a substantially curved shaped, its convex part facing the first portion of the skirt. The closure has a complicated multi-part design.

Many known screw cap closures for wine bottles usually comprise an outer shell which is made from several parts or components which in combination do not have an appropriate cost performance ratio.

SUMMARY OF THE INVENTION

It is an object of this disclosure to provide an improved and more cost efficient closure for a fluid container, especially a wine bottle.

A closure according to the disclosure usually comprises an outer shell with a top deck and a skirt extending from the top deck in an axial direction. The outer shell is made from plastic material preferably by injection molding, for example high density polyethylene (HDPE) or the like. The outer shell is, in a preferred variation, made from an environmentally friendly material falling into one or more of the following categories: recycled plastic, for example post-consumer resin (PCR); bioplastics made from biomass, such as polylactic acid (PLA) or polyhydroxyalkanoates (PHAs); or biodegradable plastics, such as polybutylene adipate terephthalate (PBAT) or polycaprolactone (PCL). The top deck is arranged at an end of the closure which is nearest to an opening of a neck finish of a fluid container after the closure has been fitted onto the fluid container. The skirt is substantially rotationally symmetric around a center axis and in mounted position covers a part of the neck finish of the fluid container after the closure has been fitted onto the fluid container. The skirt comprises a screw thread on the inside of the skirt for engagement with a corresponding screw thread of the neck finish of the fluid container. The screw thread enables the closure to be screwed tightly onto the neck finish of the fluid container. In a preferred variation the skirt comprises slits in the skirt arranged circumferentially and configured to break the skirt into two portions when the closure is first opened. Preferably, the slits are very narrow in the axial direction and extended in a circumferential direction. The skirt comprises an elongated stabilizing section fitting a corresponding elongated neck section of the neck finish of the closure. By fitting closely to the elongated neck section, the elongated stabilizing section of the skirt ensures that the skirt remains centered and aligned closely with the center axis. The skirt comprises retaining means on the inside of the skirt for engagement of a collar of the neck finish of the fluid container. The retaining means secure the closure on the neck finish of the fluid container once the closure has been fitted. The closure breaks into two portions when the closure is first opened. A bottom portion remains attached to the neck finish because of the engagement of the retaining means with the collar of the neck finish. The closure comprises robust torque engagement means arranged on the outside of the top deck for interacting with a corresponding torqueing member, e.g. a chucking head, during fitting of the closure. After filling of the fluid container, the closure is fitted onto the neck finish of the fluid container. In order to screw down the closure, torque is transferred from a torqueing member of a filling system onto the torque engagement means. The torque engagement means ensure that the closure is screwed down with a correct amount of torque for fitting. In a preferred variation, the torque engagement means are arranged in a depression of the top deck surrounded by an outer wall (edge).

In a variation, the retaining means comprise a retaining band that is folded towards the top deck. The retaining band is arranged on the inside of the skirt. The retaining band is manufactured facing away from the top deck along an axial direction. The retaining band has a shoulder which, when fitted, engages with the collar of the neck finish such that the bottom portion of the skirt, and therefore the closure, remains securely fastened to the neck finish even if a top portion of the skirt, and therefore the closure, is removed from the fluid container by unscrewing the closure.

For good results, the retaining band is folded towards the top deck in a folding step directly after injection molding and prior to fitting, increasing the speed and reliability of fitting.

In a variation, the retaining band is folded towards the retaining band during fitting of the closure through interaction with the neck finish.

In a preferred variation, the screw thread, the slits, the elongated stabilizing section, and the retaining band are arranged from the top deck in the axial direction sequentially in the named order. In particular, the screw thread is arranged downstream from the top deck in the axial direction. The slits are arranged downstream from the screw thread, the elongated stabilizing section is arranged downstream from the slits, and the retaining band is in turn arranged downstream from the elongated stabilizing section.

In a variation, the closure further comprises longitudinal fins in a trunk section of the skirt. The longitudinal fins extend along the inner side wall of the trunk section in the axial direction. The longitudinal fins are straight and arranged perpendicular to the inner side wall of the trunk section. The longitudinal fins reinforce the skirt. Alternatively, or in addition, the longitudinal fins also provide channels for molten material, in particular plastic, during molding. Thereby it becomes possible to reduce the thickness of the respective section of the closure. Due to the thinness and axial extension of the skirt, injecting molten material into the mold is greatly aided by the longitudinal fins, which help transport the molten material into all areas of the mold. The longitudinal fins may also reduce a drop of the bottom portion of the skirt after the closure has been removed for the first time by interacting with the neck finish.

In an advantageous embodiment, the skirt has, in an area of the screw thread, a reinforced zone. The reinforced zone is substantially thicker than a thickness of the rest of the skirt. The reinforced zone enables the closure to be held in a stable and secure manner by a holding member during fitting of the closure. The holding member is a component of the fitting system used for fitting the closure. In particular, the holding member holds the closure during application of torque by the torqueing member of the fitting system, the torque being received by the torque engagement means.

In a variation, the torque engagement means are arranged in a depression of the top deck in an opposite axial direction to the skirt. The depression is a recessed section of the top deck with respect to the edge of the top deck. The torque engagement means are preferably arranged inside the depression such that the torqueing member meshes with the torque engagement means to transfer torque to the closure during fitting of the closure. In the same time the closure can be centered by an outer wall as described hereinafter in more detail.

In a variation, the depression has an annular wall and the torque engagement means comprise buttresses arranged against an inner face of the wall and extending towards a center axis. The buttresses are ribs, flanks and/or protrusions which are connected to the top deck. One part of the buttresses is connected to the inner face of the annular wall. The annular wall forms a wall, lip, ring and/or band on the upper outside face of the top deck on the side opposite to the skirt. The torque engagement means are configured such that they mesh with the torqueing member during fitting. In a preferred variation, the torque engagement means are configured to prevent cam-out, such that the torqueing member does not slip out of the torque engagement means during fitting. This ensures that the closure is torqued to the exact required amount as determined by the torqueing member, as opposed to torque engagement means where cam-out or slipping is possible where it is not possible to ensure as precisely how much torque is applied.

In a variation, the torque engagement means are arranged on an outside face of the closure and comprise recesses in the closure. The recesses are arranged on an outside face of the top deck or an outside face of the skirt. The recesses allow the torqueing member to apply torque to the closure during fitting. The recesses further allow the closure to be gripped by hand when the closure is first opened.

In an example, the torque engagement means are arranged in the reinforced zone of the skirt. This ensures that during fitting, the stress applied to the closure by the torqueing member engaging with the torque engagement means does not result in the closure deforming or breaking.

In a variation, the closure further comprises a sealing liner arranged on the inside of the closure between the top deck and the neck finish of the fluid container for sealing the fluid container. The sealing liner seals the fluid in the fluid container and prevents leaks of the fluid. Further, the sealing liner prevents ingress of air or other contaminates into the fluid container.

In a preferred variation, the sealing liner is introduced into the closure after injection molding of the outer shell of the closure.

In a preferred variation, the sealing liner is a sealing disc comprising one or more sealing layers. The sealing disc is arranged in a corresponding sealing disc recess on the inside of the top deck. The sealing disc recess is formed such that the sealing disc fits tightly into the sealing disc recess and is retained even after the closure has been opened and closed many times.

Preferably, the skirt further comprises an annular bead arranged at the distal end of the skirt which abuts against the fluid container. The bead is a bottom part of the skirt which is configured to reduce a drop of a bottom portion of the skirt after the closure has been opened. During the first opening of the closure, the slits break and the bottom and top portion of the skirt separate. As the bottom portion is no longer held by the top portion it could drop further down the neck finish of the fluid container. The annular bead reduces the drop through interacting with the neck finish of the fluid container.

In a preferred variation, at least the outer shell (i.e. the closure, not including the sealing liner) is formed as one piece during injection molding. In particular, the top-deck and the skirt, and all components thereof, are integrally formed in a single-shot injection molding process. In a variation, the slits in the skirt are cut subsequently to the injection molding process. The retaining band, in its freshly molded state, initially points away from the top deck. Good results can be achieved when subsequent to injection molding the retaining band is folded towards the top deck by folding means which press the retaining band upwards to a state in which retaining band points towards the top deck.

Alternatively, the folding can take place during fitting of the closure onto the neck finish.

In a preferred variation, to allow the retaining band to deform during fitting without breaking, the retaining band is not entirely rotationally symmetric about the center axis C but has cut-outs through the retaining band.

In a variation, some or all of the steps following injection molding, which include: the cutting of the slits, the folding of the retaining band, and the introduction of the sealing liner, take place prior to fitting the closure onto the fluid container. The aforementioned steps can take place in any order, and in a variation, occur at least in part simultaneously. For example, the cutting the slits and the folding the retaining band occur at the same time, speeding up the manufacture of the closure.

In addition to the closure for the fluid container, another aspect of the disclosure is directed towards a neck finish of a fluid container. The neck finish is configured for engagement with the closure as described above. The neck finish comprises a neck screw thread for engagement with the screw thread of the closure. The neck finish comprises an elongated reinforced zone substantially thicker than a thickness of the rest of the neck finish. The elongated reinforced zone of the neck finish fits the corresponding elongated stabilizing section of the closure. The elongated reinforced zone is configured such that the elongated stabilizing section of the closure fits snugly and does not wobble much. The elongated reinforced zone includes a bottom shoulder for engagement with the retaining means once the closure has been fitted. The bottom shoulder is a change in curvature of the outside of the neck finish which provides purchase for the retaining means of the closure, such that the closure is held in place.

In a variation, the elongated reinforced zone includes a top shoulder adjacent to the neck screw thread for deflecting the retaining band of the closure towards the top deck of the closure during fitting. As the closure is fitted onto the neck finish during fitting, the top shoulder deflects the retaining band and pushes the retaining band from outwards towards an inside face of the skirt enabling the closure to be fitted onto the neck finish.

BRIEF DESCRIPTION OF THE DRAWINGS

The herein described disclosure will be more fully understood from the detailed description given herein below and the accompanying drawings which should not be considered limiting to the disclosure described in the appended claims. The drawings illustrate various variations, and together with the description serve to explain the principles and operation of the concepts disclosed, wherein:

DESCRIPTION OF PREFERRED EMBODIMENTS

Reference will now be made in detail to certain variations, examples of which are illustrated in the accompanying drawings, in which some, but not all features are shown. Indeed, variations disclosed herein may be implemented in many different forms and should not be construed as limited to the variations set forth herein; rather, these variations are provided so that this disclosure will satisfy applicable legal requirements. Whenever possible, like reference numbers will be used to refer to like components or parts.

Figure 1:
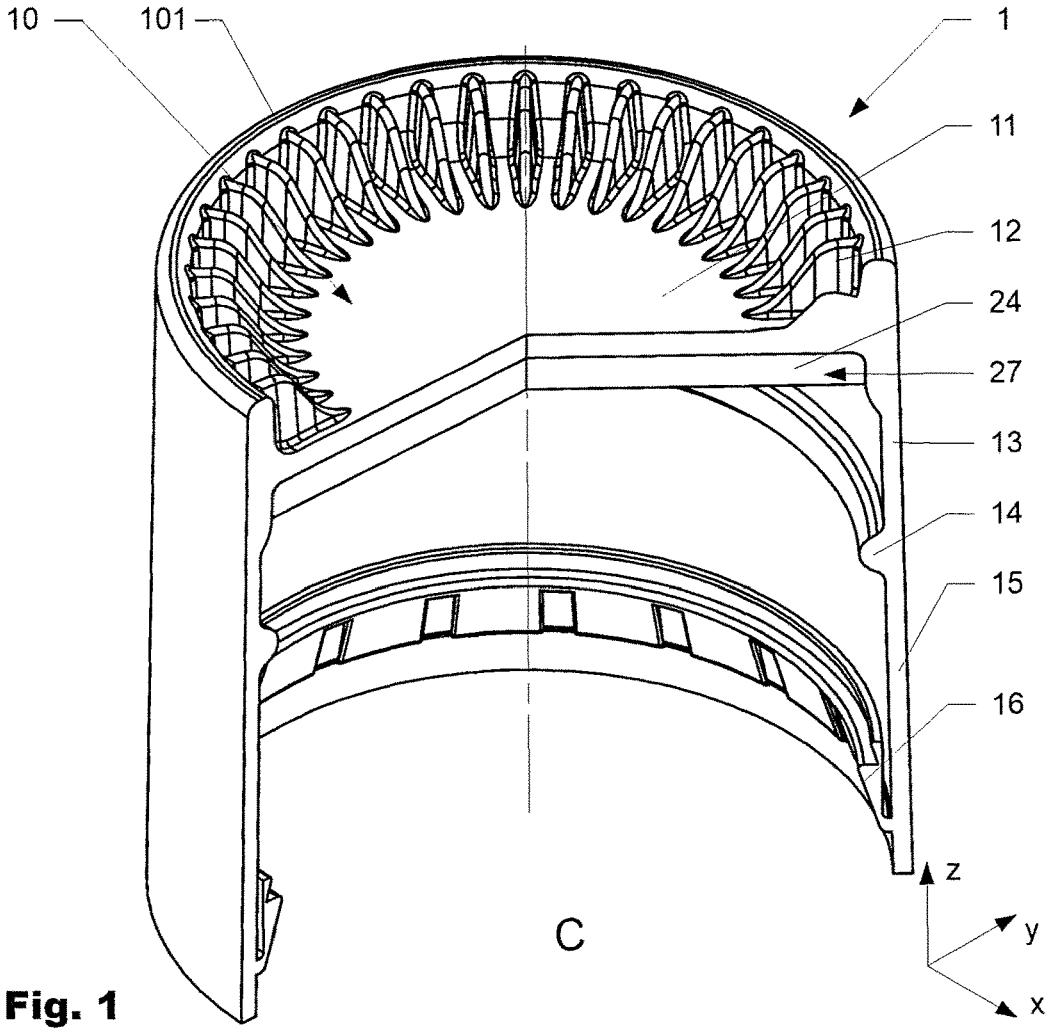
FIG. 1 shows a cut-out view of a first variation of a closure.

FIG. 1 shows a perspective view of a first variation. A closure 1 is shown in an upright orientation as when fitted onto a fluid container 3 (not shown in this figure). The closure 1 is shown in its fitted state before the fluid container 3 has been opened for the first time. The closure 1 comprises a top deck 11 arranged in the x-y plane perpendicular to a center axis C, the center axis running parallel to the z-axis. The closure 1 comprises a skirt 13. The skirt 13 extends from the top deck 11 downwards in an axial direction −z. The skirt 13 has a substantially cylindrical outer wall and is also substantially rotationally symmetric about the center axis C. The top deck 11 includes a depression 10. The top deck 11 has an outer wall 101 which rises above the depression 10 in an axial direction +z. Along the inner face of the outer wall 101 there are arranged a plurality of buttresses 12 which extend from the inner face of the outer wall 101 towards the center axis C of the depression 10 and taper in height from the inner face of the outer wall 101 towards the center axis C. The buttresses 101 are configured to mesh and engage with a torqueing member of a fitting system during fitting of the closure 1 onto the fluid container 3. An inside of the closure 1 has a sealing disc 24 arranged on the bottom of the top deck 11 in a sealing disc recess 27 which is configured to hold the sealing disc 24 securely in place, even after repeated opening and closing of the closure 1. The sealing disc 24 is a circular sealing member comprising one or more layers of one or more types of sealing material. The sealing disc recess 27 is arranged in the top deck 11 and not the skirt 13, and in particular is separated from the screw thread 14. The sealing disc recess 27 and the sealing disc 24 are shaped complementary to each other such that the sealing disc 24 fits into the sealing disc recess 27. On the inside of the closure 1, the skirt 13 comprises an inner wall with a screw thread 14 configured for engagement with a corresponding neck screw thread 34 of a neck finish 31 of the fluid container 3. An elongated stabilizing section 15 is arranged below the screw thread 14, and below that the retaining band 16 is shown in the configuration it has after being fitted onto the closure 1, namely pointing towards the top deck 11.

The closure 1 preferably comprises a synthetic material such as plastic, in particular high density polyethylene (HDPE), low density polyethylene (LDPE), polypropylene (PP), or post-consumer resin (PCR), or a combination of these materials, and is preferably injection molded. More preferably, the closure 1, not including the sealing disc 24, is integrally injected molding in a single mold as a single part.

Figure 2:
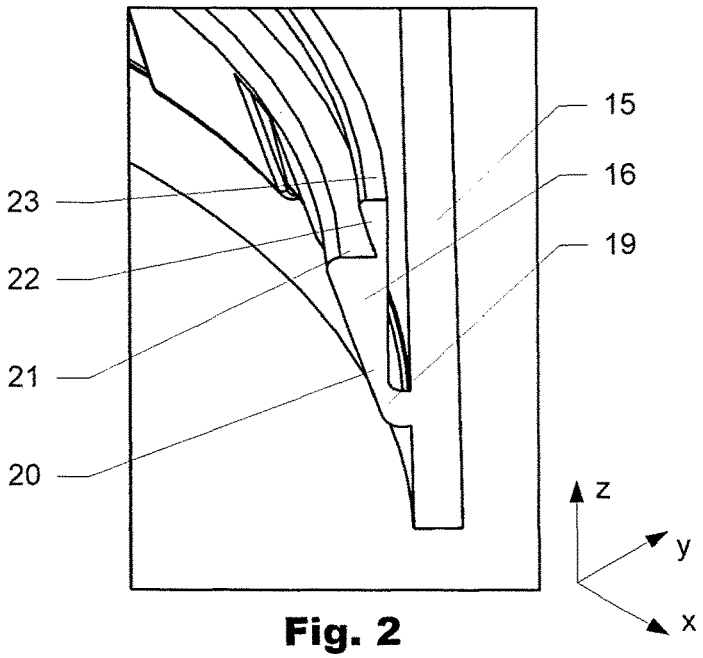
FIG. 2 shows a detailed view of the retaining band of the first variation shown in FIG. 1.

FIG. 2 shows a detailed view of the first variation, in particular of the retaining band 16 of FIG. 1 in the fitted state (fluid container 3 not shown). The retaining band 16 is joined to the skirt 13 perpendicularly and from there is bent upwards in axial direction +z towards the top deck 11. Moving away from the skirt 13 the retaining band 16 has first a folding zone 19 which undergoes a plastic deformation subsequent to injection molding. From the folding zone 19, the retaining band 16 turns upwards and thickens into a wedge shape with a wedge face 20. The wedge face 20 does not face the center axis C squarely but faces downwards slightly in the axial direction −z. The retaining band 16 is bent upwards to form, in combination with an inside face of the skirt 13, an approximately a U-shaped gap between the inside face of the skirt 13 and the retaining band 16. The distal end of the retaining band 16, which extends towards the top deck 11 when fitted, has a retaining band shoulder 21. Rising above the retaining band shoulder 21 is a projection 22. As the closure 1 is pressed down over the neck finish 31 during fitting, the retaining band 16 is bent further upwards in the axial direction z towards the top deck 11 and snaps back elastically to retain the fluid container 3. To allow the retaining band 16 to bend during fitting without breaking, the retaining band 16 is not entirely rotationally symmetric about the center axis C but has cut-outs which cut through the retaining band 16 at the wedge face 20.

Figure 3:
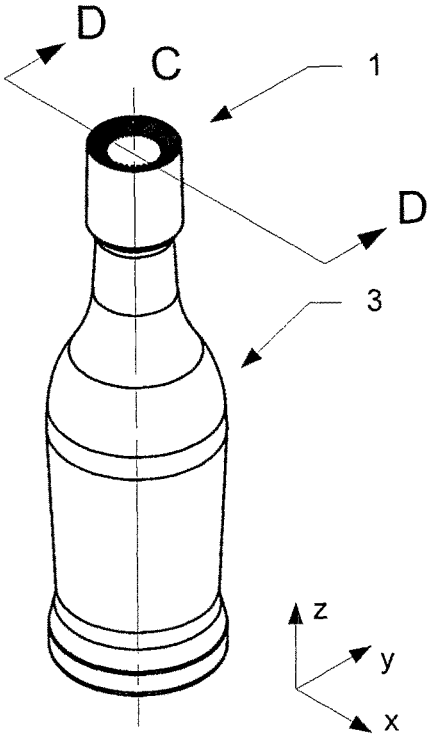
FIG. 3 shows a view of the first variation of the closure shown in FIG. 1 fitted onto a fluid container.

FIG. 3 shows a perspective view of the first variation of the closure 1 fitted onto the fluid container 3. Also shown is the center axis C and a section face D.

Figure 4:
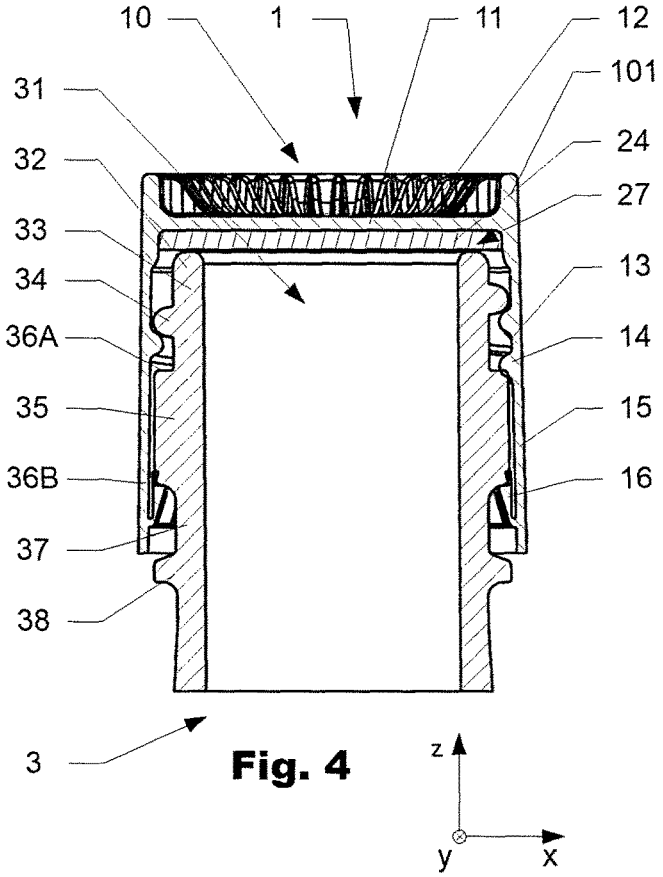
FIG. 4 shows a section view of FIG. 3.
Figure 5:
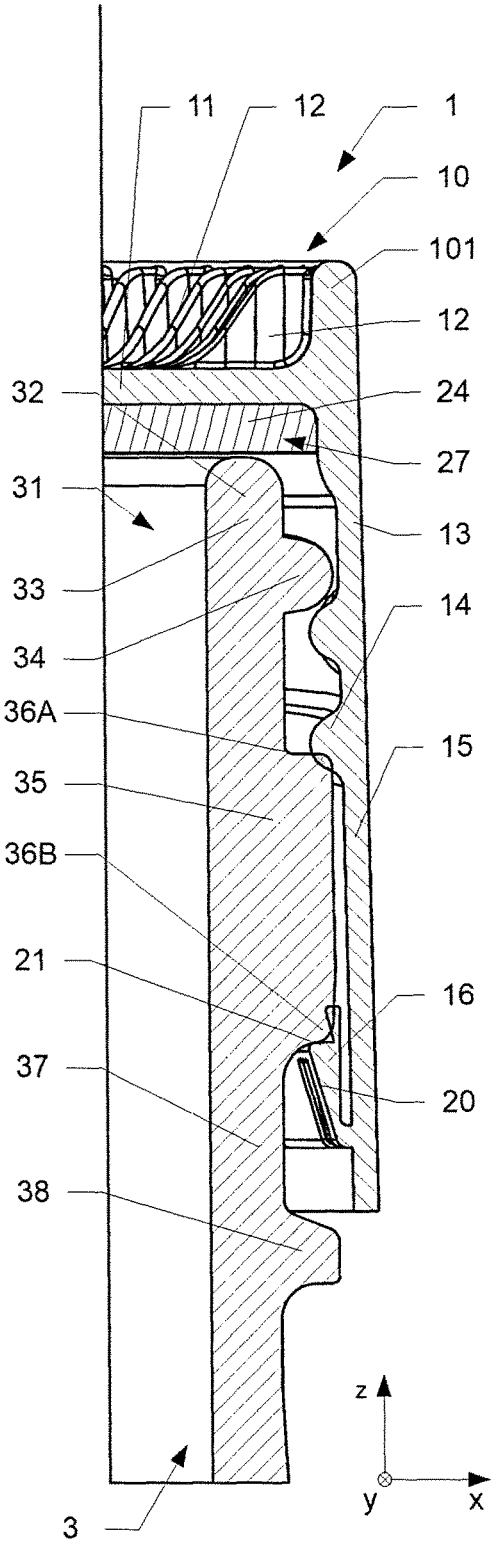
FIG. 5 shows a detailed part of the section view of FIG. 4.

FIG. 4 shows a section view of the first variation of the closure 1, in particular of the closure 1 fitted onto the fluid container 3 along the section face D of FIG. 3. The section face D intersects the center axis C and lies plane parallel to the z-y plane, z being the axial direction and y being a radial direction. Features of the closure 1 described above under the description of FIGS. 1 and 2 will not be described in detail here. Rather, this figure, and also FIG. 5 which shows a more detailed view of a part of FIG. 4, will be used to describe features of the neck finish 31 of the fluid container 3, in particular features relevant for the fitting and engagement of the neck finish 31 with the closure 1. The neck finish 31 of the fluid container 3 is an overall roughly rotationally symmetric and roughly cylindrically shaped area of the fluid container 3 through which fluid may be filled into, or emptied from, the fluid container 3. The neck finish 31 has a lip 32 which forms an opening into the fluid container 3. The lip abuts against the sealing disc 24 of the closure 1. When the closure 1 is fitted onto the neck finish 31 the lip 32 presses against the sealing disc 24 forming a tight seal such that fluid cannot escape the fluid container 3. The sealing disc 24 further prevents ingress of air or contaminants into the fluid container 3. When the closure 1 is screwed down tightly, either during fitting by the torqueing member of the fitting system or by hand after the closure 1 has been removed, the lip 32 deforms the sealing disc 24 slightly ensuring a good seal. Below the lip 32, the neck finish 31 has a neck screw thread 34 configured to engage with the screw thread 14 of the closure. Below the neck screw thread 34, the neck finish 31 has an elongated reinforced zone 35. The elongated reinforced zone 35 is a zone of the neck finish 31 with a wall thickness substantially thicker than a wall thickness of the rest of the neck finish 31. In particular, the wall thickness of the elongated reinforced zone 35 is approximately twice as thick at least as the wall thickness of the rest of the neck finish 31. A measure of the wall thickness of the neck finish 13 does not include any protrusions such as the neck screw thread 34. The elongated reinforced zone 35 has a longitudinal length, i.e. a vertical extension in the axial direction, which is greater than the wall thickness of the elongated reinforced zone 35. In a preferred variation, the longitudinal length of the elongated reinforced zone 35 is at least twice as long as the wall thickness of the elongated reinforced zone 35. The elongated reinforced zone 35 has a top shoulder 36A which demarcates the elongated reinforced zone 35 to the neck screw thread 34. The top shoulder 36A is configured such that it deflects the retaining band 16 during fitting to push the retaining band 16 outwards towards the inside face of the skirt 13, allowing the closure 1 to be fitted. The elongated reinforced zone 35 also has a bottom shoulder 36B which demarcates the bottom end of the elongated reinforced zone 35 and is configured to engage with the retaining band 16 when fitted. Below the bottom shoulder 36B, the neck finish 31 has a closure engagement zone 37 in which the neck finish 31 returns to its usual thickness. The closure engagement zone 37 is dimensioned such that the retaining band 16 of the closure 1 has space. The bottom shoulder 36B and the closure engagement zone 36 are configured such that the wedge face 20 of the retaining band 16 is not in contact with the neck finish 31 of the fluid container 3. Rather, it is the retaining band shoulder 21 and the projection 22 which engage with the bottom shoulder 36B. The bottom shoulder 36B is configured such that if the closure 1 is pulled or unscrewed after fitting, the retaining band 16 engages with the bottom shoulder 36B to prevent the skirt 13 from moving. More specifically, the slope of the bottom shoulder 36B at the point of interaction with the retaining band 16 is such that, when a force is exerted on the closure in an axial direction +z the retaining band 16 is also pressed inwards away from the skirt 13 toward the center axis C, ensuring that the retaining band 16 remains firmly engaged with the bottom shoulder 36B of the neck finish 31 and does not bend towards the skirt 13. This ensures that the closure 31 cannot be removed in its entirety after fitting. If the closure 1 is unscrewed with sufficient force, however, the slits 17 (not shown) in the skirt 13 ensure that the skirt 13 breaks into two portions, a top portion including the top deck 11 and the screw thread 14 and a bottom portion including the retaining band 16. The elongated reinforced zone 35 and the complementary elongated stabilizing section 15 of the closure 1 fit closely together to ensure that the closure 1 remains stably seated on the neck finish 31. This close fit between the elongated reinforced zone 35 and the elongated stabilizing section 15 further aids the stabilizing of the closure 1 during fitting. The neck finish 31 further comprises a retaining bead 38 below, or abutting against, the bottom of the closure 1. This ensures that when the closure 1 is first opened and therefore breaks into two portions, the bottom portion comprising the retaining bead 16 does has a reduced drop or, preferably, does not drop at all.

Figure 6:
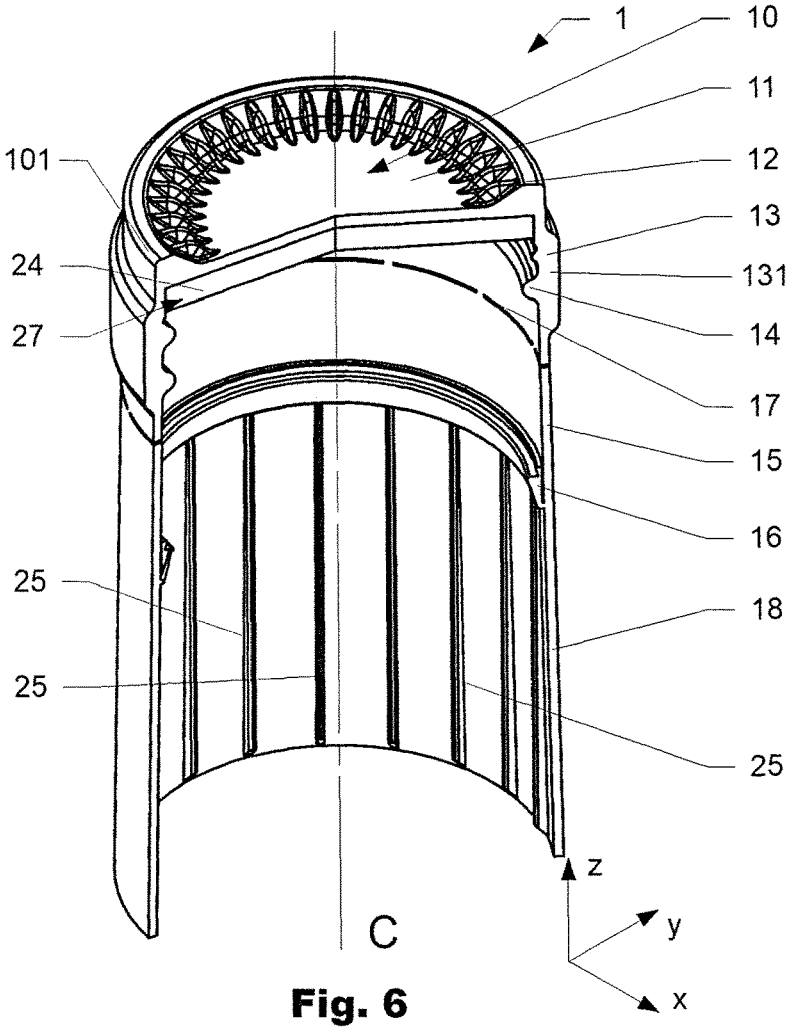
FIG. 6 shows a cut-out view of a second variation of a closure.
Figure 7:
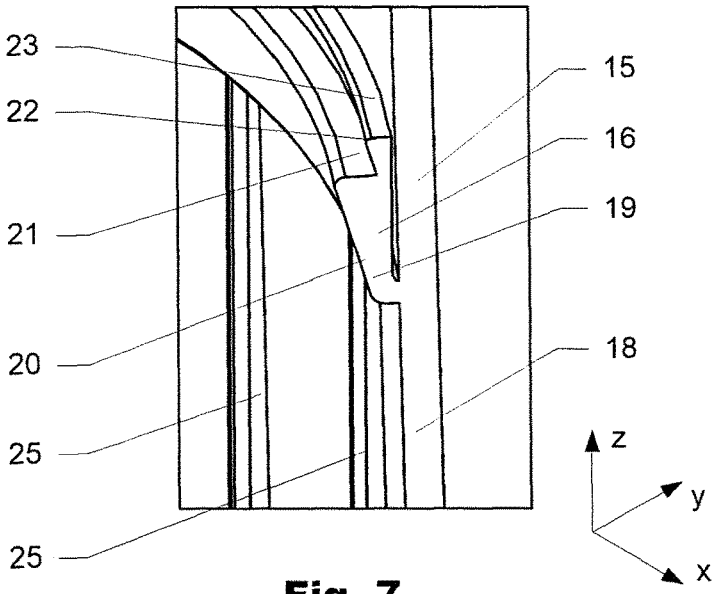
FIG. 7 shows a detailed view of the retaining band of the second variation shown in FIG. 6.
Figure 8:
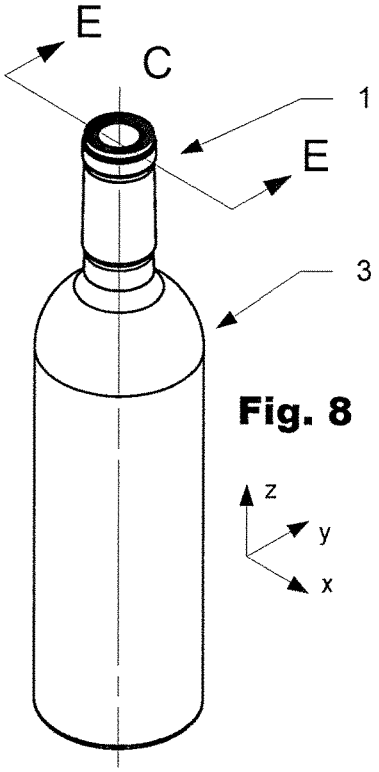
FIG. 8 shows a view of the second variation of the closure shown in FIG. 6 fitted onto a fluid container.
Figure 9:
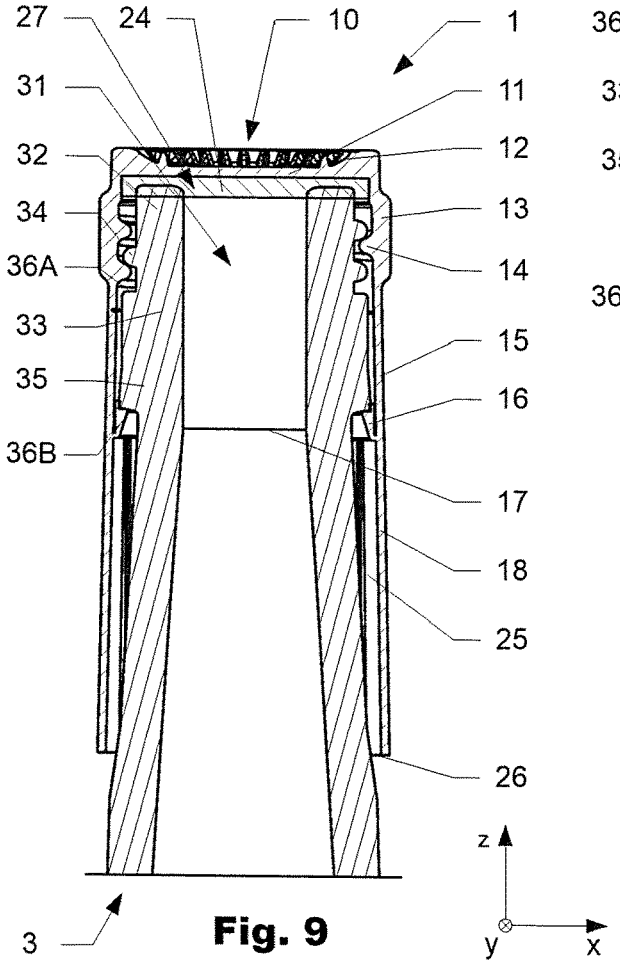
FIG. 9 shows a section view of FIG. 8.
Figure 10:
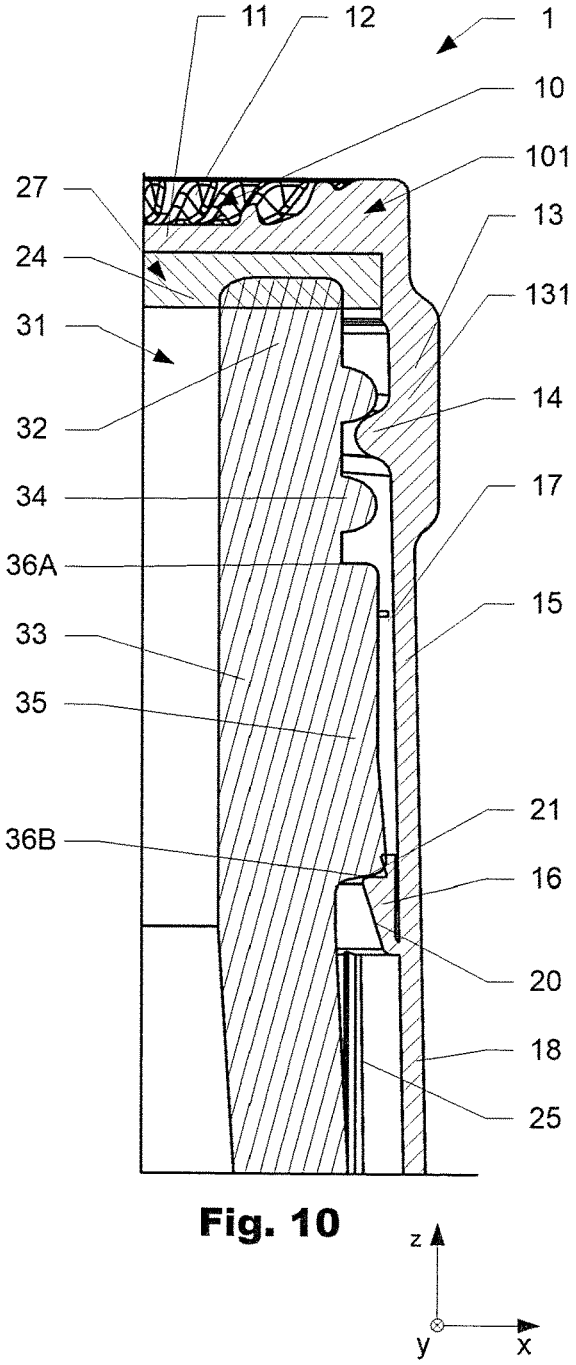
FIG. 10 shows a detailed part of the section view of FIG. 9.

FIG. 6 shows a perspective view of a second variation of the closure 1. Similarly, FIG. 7, shows a detailed view of the second variation, in particular of the retaining band 16 of FIG. 6 in the fitted state (fluid container 3 not shown). FIG. 8 shows a perspective view of the second variation of the closure 1 fitted onto the fluid container 3. Also shown is the center axis C and a section face E. FIG. 9 shows a section view of the second variation of the closure 1, in particular of the closure 1 fitted onto the fluid container 3 along the section face E of FIG. 8, and FIG. 10 shows a detail of the section view of FIG. 9. Only those features of the second variation will be described, with reference to FIGS. 6-10, if those features were not already described above in relation to FIGS. 1-5 of the first variation.

As can be seen for example in FIG. 6, the second variation shows a reinforced zone 131 in the skirt 13 in an area of the screw thread 14. The reinforced zone 131 is a thicker area of the skirt 13 adjacent to the top desk 11. The reinforced zone 131 provides extra stability for the screw thread 14 due to the skirt 13 having overall thin walls. The reinforced zone 131 ensures that the skirt 13 can be screwed and unscrewed easily. The reinforced zone 131 also allows a holding member of the fitting system to hold the closure 1 during fitting, in particular during application of torque by the torqueing member of the fitting system. Below the area of the screw thread 14, the skirt 13 has slits 17. The slits 17 in the skirt 13 are arranged around the circumference of the skirt 13. The slits 17 are elongated and separated from each other by small connecting areas which connect the bottom portion of the skirt 13 to the top portion of the skirt 13. The slits 17 are cut into the closure 1 after injection molding by a blade. The slits 17 are configured such that during a first unscrewing of the closure 1 by hand after fitting, the connecting areas break and the top portion skirt, as well as the top deck 11, is removable from the fluid container 1. Below the retaining band 16, the second variation also has a trunk section 18 in the skirt 13 extending in the axial direction −z. The trunk section 18 is a roughly cylindrical section of the skirt 13 and has an axial extension larger than an axial extension of the rest of the skirt 13. A plurality of longitudinal fins 25 are arranged on an inside face of the trunk section 18, extending along the entire length of the trunk section 18 from an area below the retaining band 16 to the bottom of the trunk section 18. The longitudinal fins 25 provide additional structural stability of the trunk section 18 and therefore the skirt 13. The longitudinal fins 25 also provide channels for molten material, in particular molten plastic, to flow during injection molding of the closure 1. As can be seen in FIG. 9, the trunk section 18 is terminated on its distal end, facing away from the top deck 11, by an annular bead 26. The annular bead 26 reduces a drop of the bottom portion of the skirt 13 after the closure 1 has been first opened because the annular bead 26 engages with the neck finish 31 of the fluid container 3. The annular bead 26 also provides additional structural strength to a bottom end of the closure 1.

The person skilled in the art understands that one or more features described in relation to the second variation can be added or combined with features described in relation to the first variation without departing from the scope of the disclosure.

The words used in the specification are words of description rather than limitation, and it is understood that various changes may be made without departing from the scope of the disclosure.

What is claimed is:

1. A closure comprising:

a top deck;

a skirt extending from the top deck in an axial direction, wherein the skirt comprises:

a screw thread on the inside of the skirt for engagement with a corresponding screw thread of a neck finish of a fluid container, slits in the skirt arranged circumferentially and configured to break the skirt into two portions when the closure is first opened, an elongated stabilizing section fitting a corresponding elongated neck section of the neck finish of the closure, and retaining means on the inside of the skirt for engagement of a collar of the neck finish of the fluid container; and torque engagement means arranged on the outside of the top deck for interacting with a torqueing member during fitting of the closure, wherein the torque engagement means are arranged in a depression of the top deck in an opposite axial direction to the skirt, wherein the depression has an annular wall and the torque engagement means comprise buttresses arranged against an inner face of the wall and extending towards a center axis.

2. The closure according to claim 1, wherein the retaining means comprise a retaining band that folds towards the top deck during fitting having a shoulder.

3. The closure according to claim 1, wherein the screw thread, the slits, the elongated stabilizing section, and the retaining band are arranged from the top deck in the axial direction sequentially in listed order.

4. The closure according to claim 1, further comprising longitudinal fins in a trunk section of the skirt, wherein the longitudinal fins extend along an inner side wall of the trunk section in the axial direction for reinforcing the skirt and providing channels for molten material during molding.

5. The closure according to claim 1, wherein the skirt has, in an area of the screw thread, a reinforced zone substantially thicker than a thickness of a remainder of the skirt for stably holding the closure with a holding member during fitting of the closure.

6. The closure according to claim 1, wherein the torque engagement means are arranged on an outside face of the closure and comprise recesses in the closure.

7. The closure according to claim 6, wherein the torque engagement means are arranged in the reinforced zone of the skirt.

8. The closure according to claim 1, further comprising a sealing liner arranged on the inside of the closure between the top deck and the neck finish of the fluid container for sealing the fluid container.

9. The closure according to claim 8, wherein the sealing liner is a sealing disc comprising one or more sealing layers arranged in a corresponding sealing disc recess on the inside of the top deck.

10. The closure according to claim 1, wherein the skirt further comprises an annular bead arranged at the distal end of the skirt which abuts against the fluid container and is configured to reduce a drop of a bottom portion of the skirt after the closure has been opened.

11. A neck finish of a fluid container configured for engagement with the closure according to one of claim 1, comprising:

a neck screw thread for engagement with the screw thread of the closure; and an elongated reinforced zone substantially thicker than a thickness of a remainder of the neck finish and fitting the corresponding elongated stabilizing section of the closure, wherein the elongated reinforced zone includes a bottom shoulder for engagement with the retaining means once the closure has been fitted.

12. The neck finish according to claim 11 configured for engagement with the closure, wherein the elongated reinforced zone includes a top shoulder adjacent to the neck screw thread for deflecting the retaining band of the closure towards an inside face of the skirt during fitting.

* * * * *